United States Patent [19]

Bauer et al.

[11] 4,403,790

[45] Sep. 13, 1983

[54] CONNECTING MEMBER IN PARTICULAR FOR A SAFETY SKI BINDING WHICH IS EQUIPPED WITH A SKI BRAKE

[75] Inventors: Helmut Bauer; Tibor Szasz, both of Vienna, Austria

[73] Assignee: TMC Corporation, Baar, Switzerland

[21] Appl. No.: 230,232

[22] Filed: Feb. 2, 1981

[30] Foreign Application Priority Data

Jan. 31, 1980 [AT] Austria ..... 493/80

[51] Int. Cl.[3] ..... A63C 9/18

[52] U.S. Cl. ..... 280/637; 280/611

[58] Field of Search ..... 280/637, 636, 625, 624, 280/615, 612, 611, 605, 809, 816, 623, 632; 364/835

[56] References Cited

U.S. PATENT DOCUMENTS 4,140,331 2/1979 Salomon ..... 280/612

FOREIGN PATENT DOCUMENTS 2016988 10/1971 Fed. Rep. of Germany ..... 280/624

2133675 1/1973 Fed. Rep. of Germany ..... 280/612

2442902 3/1976 Fed. Rep. of Germany ..... 41/625

*Primary Examiner*—Joseph F. Peters, Jr.

*Assistant Examiner*—Mitchell J. Hill

*Attorney, Agent, or Firm*—Flynn, Thiel, Boutell & Tanis

[57] ABSTRACT

A safety ski binding has a connecting member which can releasably engage the ski shoe during chair-lift travel to prevent loss of the ski should the ski binding inadvertently release. The connecting member is U-shaped, has its bight pivotally supported on the ski binding, and has two legs which converge inwardly toward each other. The free ends of the legs are bent inwardly and extend toward each other. A stepping plate is provided below the ski shoe sole and aligned receiving openings are provided on opposite sides of the shoe sole and the stepping plate. The connecting member is pivotal about its bight between an engaged position and a disengaged position in which the free ends of the legs are respectively disposed in the receiving openings in the ski shoe sole and the stepping plate.

11 Claims, 8 Drawing Figures

CONNECTING MEMBER IN PARTICULAR FOR A SAFETY SKI BINDING WHICH IS EQUIPPED WITH A SKI BRAKE

FIELD OF THE INVENTION

The invention relates to a connecting member, in particular for safety ski bindings which are equipped with a ski brake, which acts as a safety lock during chair-lift travel, which connecting member is hinged to a ski-fixed binding part or to the ski and can be secured releasably through one of its free ends to a ski shoe provided on the upper side of the ski by means of a preferably elastic locking mechanism.

BACKGROUND OF THE INVENTION

Conventional connecting members are, in general, designed like a safety strap and have been known for a long time in various constructions. For example, reference is made to Austrian Pat. No. 289 613. In this conventional construction, the connection between the ski shoe and safety ski binding or ski consists of a strap-shaped, multiply bent member which is supported non-releasably for limited pivotal movement on the safety ski binding. The strap-shaped member is secured arbitrarily releasably on the ski shoe. A disadvantage of this conventional device exists in the use of a structural part, which either is only arbitrarily releasably connected to the ski shoe or carries out in a loose condition (not locked on the ski shoe) uncontrolled swivelling movements which create a danger for the skier. Furthermore, in the case of the strap-shaped member, we deal with a relatively large, bulky structural part.

According to Austrian Pat. No. 270 471, it is also known to use a safety mechanism for skiers wherein same is positioned in the area of the safety ski binding and, as a ski shoe steps into the safety binding, creates a connection with a fastening part which is provided on the ski shoe through an automatic coupling. In this design, however, it is not possible to release the safety mechanism on the ski shoe as long as same engages the safety ski binding.

According to French Publication No. 2 147 916, it is furthermore known to design a safety mechanism consisting of a plastic material which can have one of its ends secured arbitrarily releasably on the ski shoe and its other end either ski-fixed or fastened through a detent on a ski brake, which detent releases during an overload and frees the ski brake. The disadvantages of this device are that mountings on the ski shoe are required, the safety mechanism is usable only in front of the ski shoe and a ski brake, if present, must be arranged in front of the front jaw of the binding.

All the foregoing solutions proved unfavorable according to experience, since a skier utilizing such mechanisms experiences during a fall a sudden load on the most sensitive areas of the foot. Therefore, such solutions were not successful on the market, in spite of repeated efforts.

A connecting member which is designed as a safety strap and is provided with an eyelet is described in U.S. Pat. No. 3,918,730. The end of the connecting member which is held on the ski binding can be released during a fall against the force of a spring so that the occurrence of forces which are dangerous for the leg of the skier during a fall will not cause a fracture. The ski which thus becomes detached can slide away freely through which another skier or other persons on the slope can be injured. In the case of an undesired release of the ski binding during the travel on a chair-lift, however, the ski is carried by the connecting member, since here no forces occur which are sufficient to effect a release of the ski from the ski shoe and connecting member.

A common disadvantage of these and the already described safety measures exists where a separation between the ski shoe and ski binding occurs during chair-lift travel, so that at the end of the chair-lift travel the skier has difficulties when leaving the lift. This difficulty can be recognized particularly clear in FIG. 7 of U.S. Pat. No. 3,918,730. The other mentioned solutions lead to similar situations, even when, as in the embodiment of French Publication No. 2 147 916, the ski shoe is hinged to the front jaw.

The goal of the invention is to bring help here and to design a connecting member of the above-mentioned type which maintains the ski shoe in a position of readiness to step into the ski binding even when the ski binding has released the ski shoe.

SUMMARY OF THE INVENTION

The purpose is attained inventively by the connecting member having, in the top view, an approximately U-shaped design, the two legs of the U being inclined inwardly to create an initial tension and being bent inwardly with their free ends, by the bight of the U being pivotally supported below the stepping plate or the like of the front jaw, and by both the stepping plate and the ski shoe having receiving openings on both sides which the free ends of the two legs of the U can resiliently selectively engage.

The ski shoe is held, in the case of a release at the heel holder during travel with the chair-lift, hinged to the front jaw through the inventive measure so that, in essence, a release of the ski shoe does not occur in this area and same remains centered in the front jaw. Thus it is assured that, upon leaving the chair-lift, the skier can immediately step into the heel, eliminating the danger of injury and the necessity of stopping the chair-lift. Due to the fact that the legs of the connecting member are self-tensioned inwardly toward the longitudinal axis of the ski, it is furthermore assured that the free ends of the U-shaped part of the connecting member always tend to engage the receiving openings. Through this, the connecting member, if it is pivoted into the proper position, engages the receiving openings either in the stepping plate of the front jaw (for downhill skiing) or in the ski shoe (for travel with the chair-lift). Two operating arms preferably are provided on the connecting member to facilitate such movement of the connecting member. The two operating arms can be used to disengage the free ends of the connecting member from either pair of receiving openings through a manual compression of the two ends of two operating arms, can be used to swing the connecting member into the opposite position and can then be released to lock the connecting member in this position. The skier need only ensure that the position of the connecting member at all times corresponds with the immediate use, namely, the disengaged position for downhill skiing and the engaged position for chair-lift travel.

An advantageous embodiment of the invention consists in each receiving opening being constructed in the form of a slot-shaped hole. This assures that, after travelling in snow, the entry of the connecting member therein can be carried out without difficulty, even when snow accumulates in the receiving openings. Furthermore, this permits longitudinal movement of the ski shoe during flexing of the ski.

A different thought of the invention lies in the two operating arms, viewed in the disengaged position, being bent in the area of the bight of the U-shaped connecting member to extend at an acute angle with respect to the upper side of the ski, the size of which angle equals or is larger than the angle of pivotal movement of the U-shaped connecting member between the engaged and disengaged positions. Due to the fact that the bend in each of the operating arms lies on the swivel axis of the connecting member, the most favorable lever-arm relationship is attained so that the skier, to overcome the self-tension of the connecting member, need apply only a relatively small force. Thus, the initial tension of the connecting member can be adjusted without any concern to the required degree.

A still further inventive thought lies in a handle suited for placement of the fingers of the hand of the skier being constructed or secured to the end area of each of the operating arms. Through this, the operation of the connecting member for the skier is made even easier.

According to yet a different thought of the invention, the individual operating arms are fastened on the associated leg of the connecting member by means of rivets, the area of each leg which contacts a section of an operating arm being flattened, preferably milled off, and thus adjusted to the flat operating arm. In this manner a mating connection, in which a surface lies on a surface, is created in a simple manner between each operating arm and the associated leg of the connecting member.

A further inventive development consists in the two operating arms, preferably in the area of the handle, being connected by means of an operating element, the length of which element permits a basket of a ski pole to be engaged therewith in order to facilitate operation of the element by the ski pole. With this, a swinging of the connecting member at least from the engaged position into the disengaged position can be carried out.

In a further development of this inventive thought, a rope, strap or the like is secured as an operating element to the handles of the two operating arms which are associated with the ski. The rope, strap or the like facilitates a swinging up of the two operating arms while simultaneously pulling same together, which causes the free ends of the U-shaped connecting member to be swung out of the two receiving openings in the ski shoe and to be moved into the disengaged position aligned with the receiving openings in the stepping plate. After the connecting member has been thus moved into the disengaged position, the rope, strap or the like is released and the free ends of the connecting member enter the receiving openings in the stepping plate.

It is furthermore important for the invention that, in the disengaged position of the connecting member, at least one operating arm, and preferably both operating arms, activate the circuit for an electrical indicating device, for example a warning lamp or a warning buzzer. Such warning devices are already known in ski bindings, but operating and/or closing the contacts with the operating arms of a connecting member is new.

BRIEF DESCRIPTION OF THE DRAWINGS

Further characteristics, advantages and details of the invention are now described in greater detail in connection with the drawings, which illustrate one exemplary embodiment.

In the drawings.

DETAILED DESCRIPTION

Figure 1:
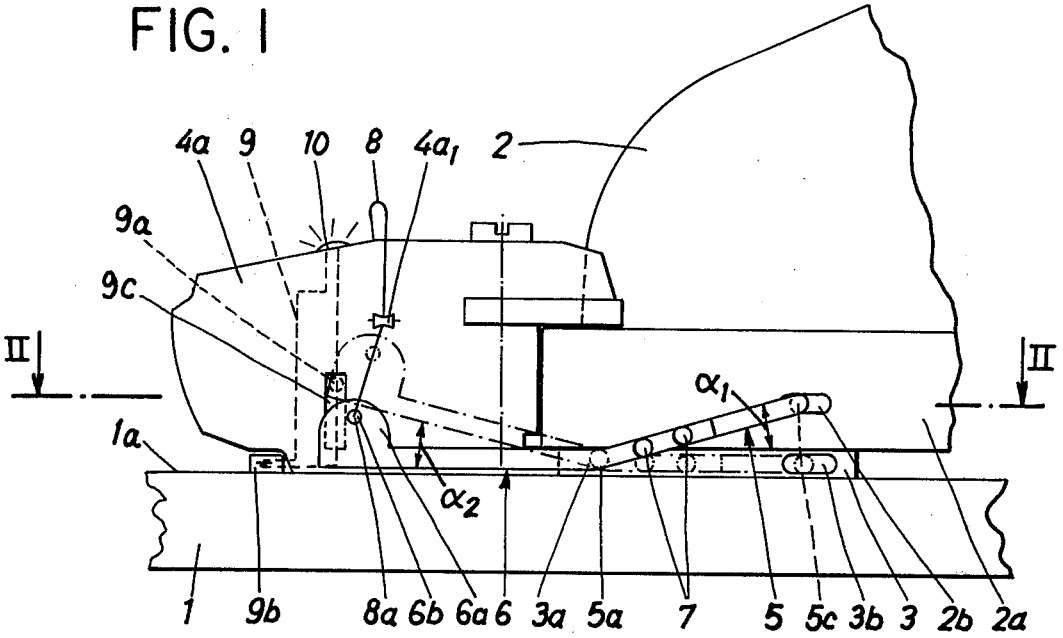
FIGS. 1 and 2*a* are associated views illustrating an inventive connecting member in connection with the front part of a ski shoe which is clamped into a front jaw of a ski binding, FIG. 1 being a side view and FIG. 2*a* being a sectional view taken along the line II—II of FIG. 1, wherein in FIG. 2*a* the front jaw, for a better view, is illustrated only in broken lines.
Figure 2A:
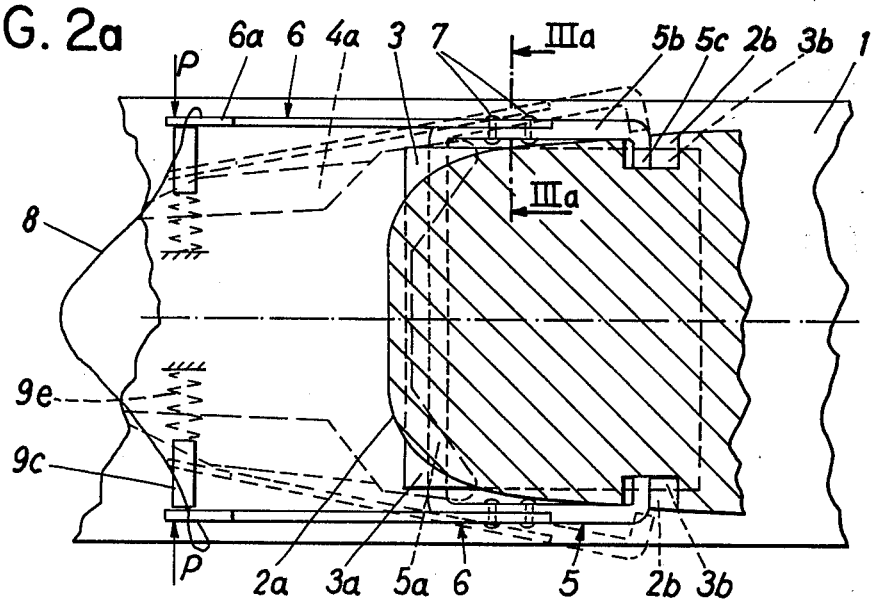
Figure 4:
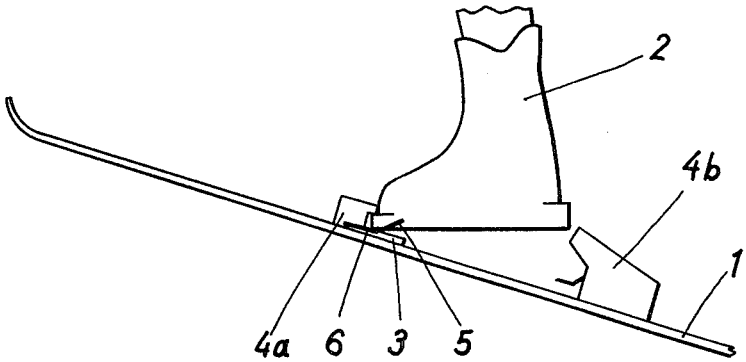
FIG. 4 is a side view of the apparatus of FIG. 1 where the ski shoe has been released in the heel area from the ski binding during travel with a chair-lift.

The front jaw 4*a* of a ski binding, which binding includes the front jaw 4*a* and a heel holder 4*b* as indicated in FIG. 4, is secured with a stepping plate 3 in a conventional manner on the upper side 1*a* of a ski 1, as shown in FIGS. 1 and 2*a*. A ski shoe 2 engages the front jaw 4*a*, the sole 2*a* of which rests on the stepping plate 3. The ski shoe 2 is clamped under spring pressure between the front jaw 4*a* and the heel holder 4*b*, the heel holder 4*b* being indicated only in FIG. 4. This is the conventional downhill skiing position for the ski shoe 2 on the ski 1.

In order to carry out downhill skiing, the skier must arrive at a certain level of height. This can be done either by climbing up the slope or by using a mechanical device, for example a chair-lift. However, travel in a chair-lift has the danger than the ski shoe of the skier, for whatever reasons, may be released from the ski binding. In most cases this occurs through an unintentional release of the ski shoe in the area of the heel holder. Although this situation had been helped until a short time ago by the use of safety straps, so that the ski remained hanging on the foot of the skier, the increased use of ski brakes in place of straps in recent years has increased considerably the danger of loss of the ski during an unpredictable release of the ski shoe. According to the invention, a connecting member 5 is provided between the ski 1 and the ski shoe 2, which member creates for the time of the use of the chair-lift a connection between the ski and the ski shoe and can be moved into a disengaged position for downhill skiing through a simple manual operation. The details of the connecting member 5 will be described hereinafter.

Figure 3:
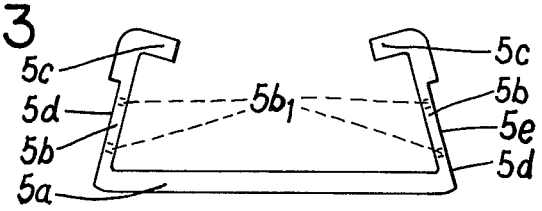
FIG. 3 is a top view of the connecting member of FIG. 1 without operating arms.

As one can best recognize from FIG. 3, the connecting member 5 has an approximately U-shaped design, wherein a bight 5*a*, two legs 5*b* and free ends 5*c* of the two legs 5*b* can be recognized. The two legs 5*b* are, in relation to the bight 5*a* of the connecting member 5, inclined at an acute angle to one another so as to converge toward each other, however, the two free ends or projections 5*c* each define with the associated legs 5*b* an approximately right angle. In relationship to the position of use of the connecting member 5, this structural part is thus pretensioned, whereby it must be remarked that the U-shaped part of the connecting member 5 consists of a spring-wire material.

As one can further observe from FIGS. 1 and 2*a*, the bight 5*a* of the connecting member 5 lies in a crossbore or grooves 3*a* of the stepping plate 3 extending transversely of the ski 1, and the two bent areas of the bight 5*a*, at which areas the two legs 5*b* of the connecting member 5 are connected to the bight 5*a* lie laterally outside of the area of the stepping plate 3. Thus, it is assured that the connecting member 5 can be pivoted relative to the stepping plate 3 about the bight 5*a* and thus also relative to the upper side 1*a* of the ski 1.

To maintain the two free ends 5*c* of the two legs 5*b* of the connecting member 5 in engagement with the sole 2*a* of the ski shoe 2 or with the stepping plate 3, respective receiving openings 2*b* and 3*b* are provided, preferably constructed as longitudinal slots. It can easily be understood that the receiving openings 2*b* in the sole 2*a* of the ski shoe 2 are aligned with one another and that the receiving openings 3*b* in the stepping plate 3 are also aligned with one another, even if each receiving opening 2*b*, 3*b* is intentionally designed as a blind hole.

Furthermore, it can particularly be recognized from FIG. 1 that the free ends 5*c* of the connecting member 5 can be selectively inserted into either the receiving openings 2*b* of the ski shoe 1 or the receiving openings 3*b* of the stepping plate 3. FIG. 1 illustrates in solid lines the engaged position of the connecting member 5, namely, where the free ends 5*c* of the connecting member 5 are positioned in the openings 2*b* in the sole 2*a* of the ski shoe 2, and in broken lines the disengaged position of the connecting member 5.

For the purpose of simplifying the operation of the connecting member 5, the two legs 5*b* each have a flat, barlike operating arm 6 connected thereto. Each operating arm 6 is secured to the respective leg 5*b* in the present exemplary embodiment by means of two rivets 7, whereby to receive the individual rivets 7 openings $5b_1$ (FIG. 3) are provided in each leg 5*b*. Each operating arm 6 has at its end which is remote from the U-shaped connecting member 5 a handle 6*a*, which handle serves as a support surface for at least one finger of the hand of the skier and accordingly has a suitable size. Each operating arm 6 extends at an acute angle $\alpha_2$ (FIG. 1) in relation to the plane containing the connecting member 5, the size of which angle is at least as great as the angle $\alpha_1$ (FIG. 1) between the engaged position and the disengaged position of the connecting member 5. It will be recognized that $\alpha_1$ can equal $\alpha_2$ in a marginal case. To allow for possible imprecision, however, it is advantageous if $\alpha_2 > \alpha_1$. Then it is assured that, when the operating arms 6 are in the engaged position illustrated in solid lines in FIG. 1, there is a sufficient amount of space above the upper side 1*a* of the ski 1 for movement of each operating arm 6. Without this clearance the operating arm 6 would contact the upper side 1*a* of the ski 1 before the free ends 5*c* of the leg 5*b* of the connecting member 5 were aligned with the receiving openings 2*b* of the sole 2*a* of the ski shoe 2.

Figure 3A:
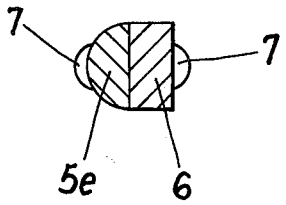
FIG. 3*a* is a cross-sectional view along the line III*a*—III*a* of FIG. 2.

To effect a secure connection between each operating arm 6 and the respective leg 5*b* of the connecting member 5, each leg 5*b* is flattened (milled off) at least in the area in which it engages the associated operating arm 6. This flattened portion is identified in FIG. 3 with reference numeral 5*e*. This development is made clear in the cross-sectional view of FIG. 3*a*.

Each handle 6*a* of the individual operating arms 6 has an opening 6*b* in which is secured a free end 8*a* of an operating element 8 which is, for example, a rope, a strap or the like. The length of the operating element 8 is preferably selected so that the skier can operate the two operating arms 6 by engaging the element 8 with the basket of the ski pole. The operating element 8 is guided through guide rollers $4a_1$ (FIG. 1) provided on opposite sides of the front jaw 4*a*, such that pulling on the operating element 8 generates a lateral force component on the two operating arms 6 in the direction of the two arrows P as well as an upward force component, just as if the two arms 6 had been operated manually. The connecting member 5 can thus be moved from the engaged to the disengaged position.

The two operating arms 6 and the two legs 5*b* of the connecting member 5, which legs are connected to the operating arms 6, can be swung between the engaged and disengaged position, causing the connecting member 5 to be swung upwardly or downwardly, depending on whether a transition from the engaged position for travel with the chair-lift to the disengaged position for downhill skiing is desired, or vice versa. Since the connecting member 5, as has already been mentioned, has a self-tension, it is sufficient if the skier lets go of the operating arms 6 in the desired position, because the movement of the free ends 5*c* into the aligned receiving openings 2*b* or 3*b* then occurs automatically. Due to the slotlike design of the individual receiving openings 2*b*, 3*b*, it is furthermore assured that the engagement therewith of the free ends 5*c* of the individual legs 5*b* of the connecting member 5 is effected even if snow accumulates during skiing in the individual receiving openings 2*b*, 3*b*. In the extreme case that a layer of ice forms in a receiving openings, such layer can easily be removed by means of the tip of the ski pole or by a different tool. Furthermore, the slot-shaped openings 2*b* and 3*b* permit relative movement between the ski shoe and the ski binding during flexing of the ski.

In addition, it is remarked that the dash-dotted lines illustrate the disengaged position of the connecting member 5, which position is used for downhill skiing. If the skier lets go of the operating arms 6 in this position, the two free ends 5*c* of the legs 5*b* of the connecting member 5 will move into engagement with the receiving openings 3*b* of the stepping plate 3.

Figure 2B:
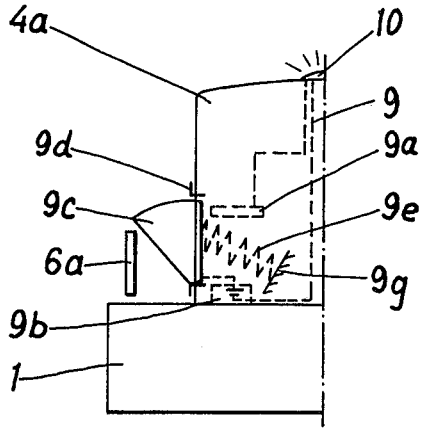
FIGS. 2*b*, 2*c*, and 2*d* are similar diagrammatic rear views of a portion of the front jaw of FIG. 1 and show respective operational positions of a warning apparatus which is provided in the front jaw of FIG. 1.
Figure 2C:
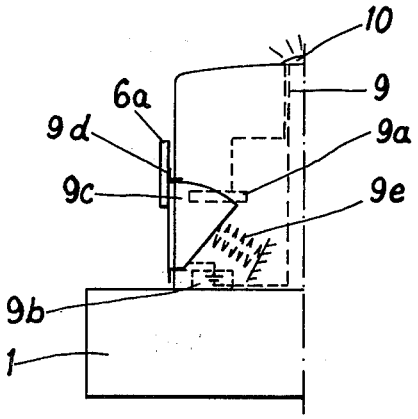
Figure 2D:
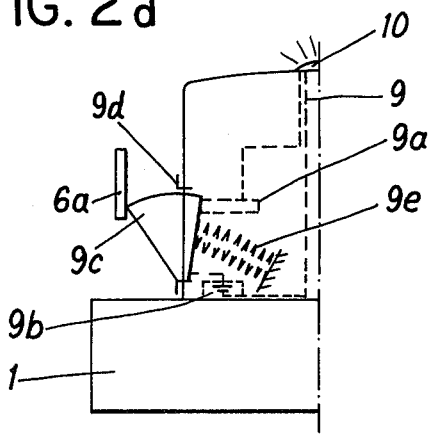

A potential danger exists in the present solution, insofar as the skier could forget to change over from the engaged position to the disengaged position before commencing downhill skiing. To bring help here, a signal emitter 10 (FIG. 1), for example in the form of a lamp or a buzzer, is provided on the front jaw 4*b*, which signal emitter 10 is electrically connected by means of an only indicated line 9 to a contact or switch 9*a* located in the moving area of an operating arm 6. The line 9 is connected in a conventional manner to a battery or similar current source 9*b*. The arrangement of such warning devices is known. In particular, the details of the insulation and the arrangement of the battery do not need to be discussed separately. New, however, is the fact that the operating arm 6 of the connecting member 5 is used for indicating the engaged position of the safety mechanism used for travel with the chair-lift. Basically, it is alternatively possible to indicate the disengaged position, as shown in FIGS. 2*b*, 2*c* and 2*d* and described in detail hereinafter, but for safety reasons it appears to be more advantageous if the engaged position is indicated, in order to remind the skier prior to the commencement of downhill skiing of the necessary change-over. This is particularly important when a release of the ski shoe does not occur during travel with the chair-lift, since the skier arriving at the desired station is often anxious to begin downhill skiing immediately. In this case the contact mechanism should be accordingly amended.

FIG. 4 schematically illustrates which position the ski 1 assumes relative to the shoe 2 when the heel holder 4*b* has released the ski shoe 2. From this figure, and in particular in connection with FIGS. 1 and 2*a*, it can be recognized that the ski shoe maintains its centered position relative to the front jaw 4*a* even when the shoe heel has been released by the heel holder 4*b*. This circumstance is advantageous for effecting re-engagement of the ski shoe 2 and heel holder 4*b* upon arrival at the exit station, since the ski 1 with the heel holder 4*b* is at all times in the stepping-in position below the shoe 2 and the skier does not have to be particularly coordinated to exit without an accident from the lift and to immediately step into the ski binding 4*a*, 4*b*. As shown in FIGS. 2*b*, 2*c* and 2*d*, a circuit 9 includes a wire coming from the battery 9*b* is connected and one end of a contact member 9*c* which is pivotally supported in a bearing 9*d* of the front jaw 4*a*. The contact member 9*c* is based by means of a spring 9*e* having one end supported by a fixed part of the front jaw 4*a*.

In the locked position of the operating arm 6 the handle 6*a* of this arm 6 is in its lowest position, which is shown in FIGS. 1 and 2*b*. Between the contact member 9*c* and the handle 6 of the operating arm 6 is a space, thereby ensuring that, due to the force of spring 9*e*, the contact member 9*c* does not touch the contact 9*a*. The signal emitter 10 is thus not energized. By pressing the handles 6*a* and moving the operating arm 6 to its uppermost position, shown in FIG. 2*c*, the contact member 9*c* is pivoted against the force of the spring 9*e* to the position which is shown in FIG. 2*c*, thereby closing the electric circuit so that a signal is emitted from the light or buzzer 10.

When both the operating arms 6 lie in the position in which the free ends 5*c* of the connecting member 5 are disposed in the openings 3*b* of the stepping plate 3, the contact member 9*c* is pivoted by the spring 9*e* the position which is shown in FIG. 2*d*. Since in this position the arm 6 still holds the contact member 9*c* in engagement with the contact 9*a*, the electrical circuit is closed as mentioned above and the signal continues to be emitted from the light or buzzer 10. That means that only in the locked position of the operating arm 6 (FIGS. 1 and 2*b*) is the signal not emitted by the light or buzzer 10.

The invention is not limited to the illustrated exemplary embodiment. Modifications exist without leaving the scope of protection. For example, the free ends 5*c* of the legs 5*b* of the connecting member 5 can also be bent relative to the plane containing the two legs 5*b* and the bight 5*a*, if this is desired for safety reasons. Also, the individual receiving openings, in particular the receiving openings 2*b* in the sole of the ski shoe, can extend at an angle relative to a plane which is parallel with the upper side of the ski. Through this it can be assured that the connecting member 5 has, in the engaged position, a more secure engagement with the receiving openings than in the disengaged position.

Furthermore, the contact 9*a* for the operating arm 6 can be provided on the stepping plate 3 or on a possibly separate base plate of the front jaw 4*a*, rather than on the front jaw 4*a*.

The embodiments of the invention in which an exclusive property or privilege is claimed are defined as follows:

1. In an apparatus adapted to interconnect a ski boot and ski, including binding means adapted to be mounted on said ski and engageable with said ski boot for releasably securing said ski boot on the upper side of said ski, said binding means automatically releasing said ski boot in response to a force in excess of a predetermined value which urges relative movement of said ski boot and ski, and further means for interconnecting said ski boot and ski, said further means being adapted for manual engagement and release, the improvement comprising wherein said binding means includes a plate which is disposed between said ski boot and ski and has a first opening in each laterally facing side thereof, where in said further means includes said ski boot having a second opening in each side of the sole thereof, said second openings being disposed approximately above said first openings when said ski boot is releasably secured in said binding means, wherein said further means includes a generally U-shaped, resiliently flexible connecting member having a bight and two legs, said legs each having an inward projection thereon at the end thereof remote from said bight, said bight extending generally transversely of said ski and said connecting member being pivotally supported for movement about a transverse horizontal axis between first and second positions, said projections on said legs each being engageable with a respective said first opening when said connecting member is in said first position and a respective said second opening when said connecting member is in said second position, and wherein said further means includes manually actuable operating means cooperable with said connecting member for flexing said legs resiliently outwardly and facilitating pivotal movement of said connecting member between said first and second positions.

2. The apparatus according to claim 1, wherein said legs of said connecting member converge slightly.

3. The apparatus according to claim 1, wherein said operating means includes two manually actuable operaing arms, each having one end secured to a respective said leg of said connecting member and extending in a direction substantially opposite such leg.

4. The apparatus according to claim 1, including switch means, including means for actuating said switch means when said connecting member is in one of said first and second positions, including indicator means, and including electrical circuit means interconnecting said switch means and indicator means, said electrical circuit means activating said indicator means in response to actuation of said switch means.

5. The apparatus according to claim 1, wherein said binding means includes a front jaw and a heel holder adapted to releasably hold opposite ends of said sole of said ski boot, and wherein said further means is located in the region of said front jaw and, when said connecting member is in said second position and said projections thereon are engaging said second openings, maintains said sole of said ski boot in engagement with said front jaw when said heel holder releases.

6. The apparatus according to claim 1, wherein said connecting member is a single piece of bent wire material, the outer ends of said legs thereof being bent inwardly to define said projections, and including means cooperable with said bight of said connecting member for effecting said pivotal support of said connecting member.

7. The apparatus according to claim 1, wherein each of said first and second openings is a slot.

8. The apparatus according to claim 3, wherein said operating arms are each bent approximately in the region of said bight of said U-shaped connecting member and, viewed frm the side when said connecting member is in said first position, are inclined upwardly and define an acute angle with respect to the upper side of said ski which is at least as large as the angle of pivotal movement of said U-shaped connecting member between said first and second positions.

9. The binding according to claim 8, wherein at the end of each of said operating arms remote from said connecting member is a manually engageable handle.

10. The binding according to claim 3, wherein each said operating arm is flat and is secured on the associated leg of said connecting member by rivets, and wherein the portion of each leg which contacts a portion of the associated operating arm is flattened to conform it to the flat operating arm.

11. The binding according to claim 9, wherein said operating arms, in the region of the ends thereof remote from said connecting member, are each connected to a respective end of an elongate operating element.

* * * * *